United States Patent [19]

Gubsky et al.

[11] 4,020,663

[45] May 3, 1977

[54] PLANT FOR EXPLOSIVE FORMING

[76] Inventors: Alexei Alexeevich Gubsky, ulitsa Ekonomicheskaya, 7, kv. 13; Vladimir Karpovich Borisevich, ulitsa Chkalova, 15, kv. 17; Anatoly Ivanovich Volkov, ulitsa Chkalova, 15, kv. 36; Valery Matveevich Molchanjuk, pereulok Shexpira, 3, kv. 8, all of Kharkov, U.S.S.R.

[22] Filed: Feb. 23, 1976

[21] Appl. No.: 660,393

Related U.S. Application Data

[63] Continuation of Ser. No. 587,211, June 16, 1975, abandoned, which is a continuation of Ser. No. 519,034, Oct. 29, 1974, abandoned, which is a continuation of Ser. No. 429,395, Dec. 28, 1973, abandoned.

[52] U.S. Cl. ..... 72/56

[51] Int. Cl.[2] ..... B21D 26/08

[58] Field of Search ..... 72/56, 60–62; 29/421 E

[56] References Cited

UNITED STATES PATENTS

| | | | |
|---|---|---|---|
| 3,065,720 | 11/1962 | Kardin | 72/56 |
| 3,485,075 | 12/1969 | Kiselev et al. | 72/56 |
| 3,518,860 | 7/1970 | Pikhtovnikov et al. | 72/56 |
| 3,611,766 | 10/1971 | Klein et al. | 72/56 |
| 3,641,796 | 2/1972 | Hertel et al. | 72/56 |

FOREIGN PATENTS OR APPLICATIONS

| | | | |
|---|---|---|---|
| 262,832 | 12/1964 | U.S.S.R. | 72/56 |

*Primary Examiner*—Milton S. Mehr

[57] ABSTRACT

A plant for explosive forming of articles of different size in which a splitter mounted on a shock absorber is on a support located near and separate from a vessel containing a die having a blank secured thereto. This makes it possible to relieve the vessel from the load during the detonation of a charge and, hence, to increase the dimensions of the charge which in turn offers an increase in the range of components to be formed on a single plant.

6 Claims, 7 Drawing Figures

PLANT FOR EXPLOSIVE FORMING

This is a continuation of application Ser. No. 587,211 filed June 16, 1975 which in turn is a Continuation of Ser. No. 519,034 filed 10/29/74, which in turn is a Continuation of Ser. No. 429,395 filed Dec. 28, 1973, all abandoned.

BACKGROUND OF THE INVENTION

The present invention relates to apparatus for metal working by pressure and more particularly to plants for explosive forming of articles of different sizes.

The invention may be most advantageous in the explosive forming of large-size intricate components from sheet bars or blanks in the form of shells.

The present invention may be particularly useful for the aircraft industry in producing components of any shape desired without resorting to welding, with the components meeting particularly precise requirements as to the accuracy of their outline and surface roughness. Explosive forming is most efficient in this case, insofar as it involves a very simple technique and the production of only one element of a die assembly, namely the die.

PRIOR ART

A plant is known in the art for explosive forming comprising a vessel with a die set up therein and adapted to mount a blank which is secured to the die; a means for liquid medium also is enclosed in the vessel, with the liquid medium being adapted for transmitting the energy of detonation of a charge disposed in the medium to the blank, and a splitter installed above the vessel for dissecting a column of the liquid medium formed by the explosion. Such plants are often located indoors.

Before the explosion of the charge, a steel cylindrically shaped hood is mounted above the vessel and fixed rigidly thereto, with the stationary splitter being secured to the top portion of the hood. The splitter is made up of two conjugated semi-tores with a rib being formed at the point of their conjugation to dissect and turn the column of the medium during the detonation. To increase the mass of the splitter, the space between the hood and splitter is filled with water or some other fluid. Upon detonation, the column of the liquid medium featuring a high kinetic energy collides with the splitter thus transmitting the dynamic load through the cylindrically shaped hood to the fasteners which serve to secure the hood to the vessel. As a result, the entire plant is subjected to tensile loads which may lead to its failure. To preclude its failure, a very cumbersome plant is used, made from steel plates and fitted with substantial clamping devices. All of the foregoing leads to inconveniences both in manufacture and in service.

After the detonation, the plant is stripped by a crane.

Upon releasing the hood from the clamping devices, it is removed by a crane and mounted on the erection ground, the die with the component is stripped and prepared for the next operation. The vessel is freed from leftovers composed of the detonation products and liquid medium.

A disadvantage of the known plant resides in that the splitter is rigidly coupled with the vessel. Upon detonation of the charge, all the energy taken up by the splitter is transmitted through the hood to the vessel. In the course of operation, both the vessel and fasteners are subjected to heavy impact loads which may result in the plant failure. The need for the removal and subsequent erection of the hood and the splitter before each explosion decreases the output of the plant and calls for additional production floor space to be utilized for the erection ground.

OBJECTS AND SUMMARY OF THE INVENTION

The object of the present invention is to eliminate the above-mentioned disadvantages and to provide a plant for explosive forming whose inherent design is more convenient and reliable in service and which meets safety practice requirements when the process is carried out indoors.

The above and other objects are achieved in a plant for explosive forming comprising a vessel provided with a die set up therein and adapted to mount a blank which is secured to the die, means for liquid medium also enclosed in the vessel, with the medium being adapted to transmit the energy of detonation of a charge disposed within the medium to the blank, and a splitter installed above the vessel to dissect a column of the liquid medium formed by the detonation.

According to the invention, the splitter is mounted on a support arranged near and separate from the vessel and connected to it through a shock absorber.

Owing to the above arrangement the vessel is completely relieved from the impact loads developed during the detonation of the charge whereby the vessel service life is increased and it is possible to manufacture the vessel from comparatively thin metal sheets.

The fact that the splitter is coupled with the support through the shock absorbers makes it possible to damp a substantial fraction of the kinetic energy taken up by the splitter by proper selection of resilient elements featuring the requisite rigidity. The above-described coupling between the splitter and the support enables a 2 – 2.5-fold increase in the weight of the charge as compared to the prior-art plants along with an increase in the dimensional range of the components being formed.

It is expedient that the splitter support be defined by at least two pillars carrying a spring-biased cross-arm which mounts the splitter, with the cross-arm being mounted to allow the cross-arm to turn about one of the pillars in the course of erection of the die with the blank and their removal from the vessel.

Through the use of the rotatable spring-biased cross-arm carrying the splitter, the vessel interior can be emptied for the subsequent erection of the die, and the pillars relieved partially from the load developed at the moment of the explosion without resorting to powerful hoisting gears.

The cross-arm with the splitter does not require any erection ground to be used, insofar as it is always located on the pillars above the vessel.

According to one of the embodiments of the present invention, the splitter constitutes a conical case filled with a tough mass with the case edges being flanged and bent downwards, with the case apex facing the vessel and the apex angle being chosen in accordance with the charge dimensions and the volume of the liquid medium transmitting the energy of detonation to the blank.

Due to the above described design of the splitter the column of the liquid medium formed by the explosion can be dissected smoothly and turned through 180°.

The process is accompanied by the self-braking of medium particles.

According to another embodiment of the present invention, the splitter is enclosed in a conical perforated case with flanged edges bent downwards with a smaller diameter of the case slightly exceeding the maximum diameter of the splitter.

The provision of the perforated case promotes the process of self-braking of the medium particles ejected during the explosion and precludes absolutely the ingress of the medium into the premises. This is achieved due to the fact that upon being turned by the cone flanges of the splitter, the stream of the medium is splashed on the perforated case in fine particles which pass through the case openings and encounter the medium in counterflow to the particles. This results in an additional self-braking of the medium and in a partial relieving of the splitter shock absorbers.

Still another embodiment of the splitter envisages the use of a splitter enclosed in a truncated conical case flanged outwardly along its large diameter and inwardly, into the case cone, along its smaller diameter with the inwardly-flanged portion of the conical case being perforated.

The splitters of the above-mentioned design are utilized when the charge approaches in size to its maximum value for which the plant is designed. With a comparatively small volume of the liquid medium and considerable kinetic energy released during the explosion, the splitter of the above construction allows relieving the shock absorber.

To enable a more convenient erection, it is expedient that the splitter be fastened to a plate adapted to connect it to the shock absorber.

In case the column of the liquid medium formed by the explosion is comparatively small in cross-section, it is desirable that the splitter be provided with a spring-biased rod adjacent to the cone base and passing through an opening provided in the plate to enable its vertical transfer relative to the plate at the moment of detonation of the charge. Due to the above design of the splitter, the shock absorber can be partially relieved.

For a better understanding of the present invention, given hereinbelow is a detailed description of exemplary embodiments thereof, to be had in conjunction with the accompanying drawings, wherein:

DETAILED DESCRIPTION OF THE EMBODIMENTS

Figure 1:
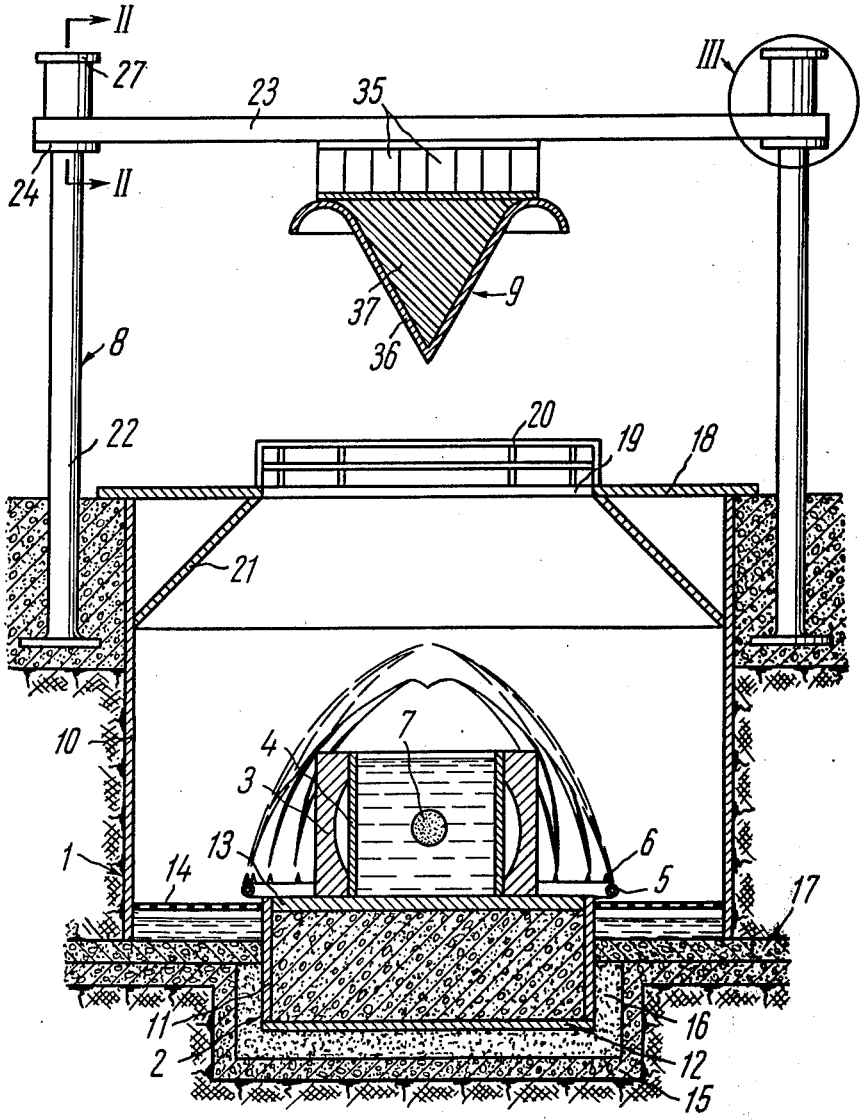
FIG. 1 is a schematic longitudinal axial section of the plant for explosive forming, according to the invention.

A plant for explosive forming comprises a vessel 1 (FIG. 1) embedded in soil with the vessel bottom supporting an anvil block 2 which serves as a foundation for a die 3 mounted thereon. The die 3 incorporates a blank 4. The die 3 is contained in a header provided with jets 6 for supplying liquid medium transmitting the energy of detonation to the blank 4. In this embodiment, a component with a closed outline is explosive-formed. Therefore, the space of the blank 4 mounted in the die 3 is filled with the liquid medium which is adapted to transmit the energy of detonation to the blank 4. Usually water is used as a liquid medium.

At the center of the water volume enclosed in the space of the blank 4, there is arranged a charge 7 suspended from a cross-piece (not shown in the drawing) which rests on the die 3. The dimensions of the charge 7 are chosen in accordance with the material and overall dimensions of the blank 4 and configuration of the component to be formed.

Mounted above the vessel 1 on a support denoted generally 8 is a splitter 9 adpated to dissect a column of water set up by the explosion.

The vessel 1 is a cylindrically shaped shell 10 completely embedded in soil. In the bottom part of the vessel 1 is arranged the anvil block 2 which is essentially a steel cylindrical shell 11 grouted with reinforced concrete. The shell 11 of the anvil block 2 is closed from below (as shown in the drawing) by a flat steel bottom 12 to which concrete reinforcements are welded. The top portion of the anvil block 2 is a substantial steel plate 13 placed on a layer of rubber (not shown in the drawing). The shell 11 of the anvil block 2 is in communication with the shell 10 of the vessel 1 through a horizontal grating 14 for draining water. The anvil block 2 is mounted on a cushion comprising a gravel layer 15 and a sand layer 16. The shell 10 of the vessel 1 rests on a concrete pad 17 which acts as the bottom of the vessel 1. The shell 10 is provided with a door (not shown in the drawing) located level with the grating 14 and adapted to provide free access for the plant attending personnel and to close an under-ground passage-way to the premises where a plate control panel is installed.

The anvil block 2 carries the die 3 incorporated in the header 5 which is an annular horizontal pipe with the jets 6, located in the top portion of the header 5. In the jets 6 provision is made for adjusting the water flow rate and directing its stream according to the overall dimensions and design of the die 3 and the size of the charge 7. The header 5 is secured to the shell 11 of the anvil block 2 and is connected to a water pressure main.

The vessel 1 is closed with a cover 18 provided with an opening 19 through which the die 3 is erected and removed from the vessel 1.

The opening 19 is surrounded by a guard 20 as a safety precaution. The vessel 1 accommodates a truncated conical case 21 whose smaller diameter is welded to the cover 18 along the perimeter of the opening 19 and the larger diameter to the shell 10. The case 21 serves for the focusing of both the water column and detonation products. The space formed by the case 21, cover 18 and shell 10 incorporates lighting means and television cameras necessary to provide supervision of the processes of detonation and erection of the die 3, blank 4 and charge 7.

Mounted above the vessel 1 on the support 8 is the splitter 9. In this case, the support 8 is defined by two pillars 22 installed on a concrete foundation and not connected with the vessel 1. In other words, the pillars 22 are separate from and independent of the vessel 1. The pillars 22 support a cross-arm 23. According to the invention, the cross-arm 23 is springbiased and mounted on the pillars 22 so as to allow it to turn about one of the pillars during the erection of the die 3 with the blank 4 and their removal from the vessel 1.

Figure 2:
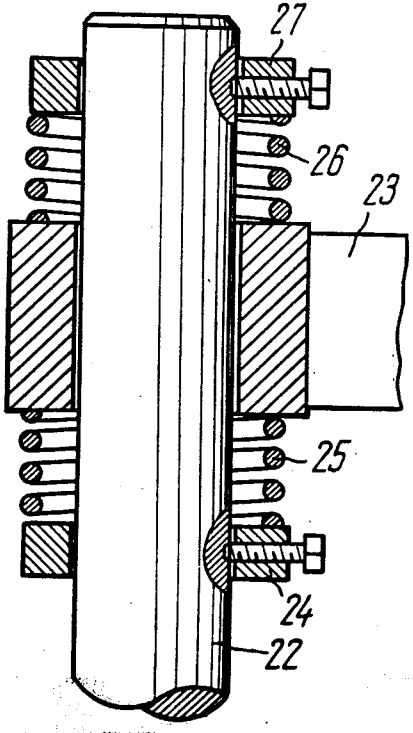
FIG. 2 is a view taken along the line II—II of FIG. 1 the view looking in the direction of the arrows and being on a larger scale.

The pillar 22 about which the cross-arm 23 is turned, in this particular case the left-hand (according to the drawing) pillar, carries a check or stop ring 24 (FIG. 2) with a spring 25 located between the ring and arm and on which the cross-arm 23 rests.

The end of the pillar 22 projecting beyond the cross-arm 23 carries a spring 26 which is placed thereon and secured with the help of a check or stop ring 27.

Figure 3:
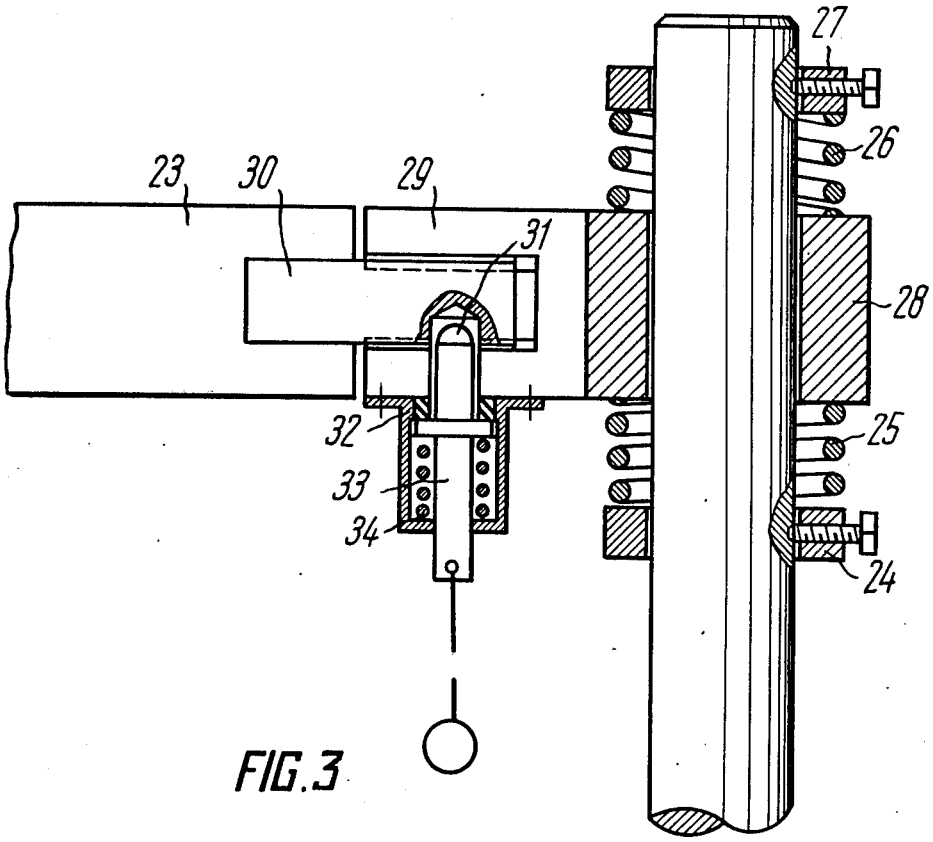
FIG. 3 is a longitudinal axial sectional view of the circled area III of FIG. 1, the view being on an enlarged scale.

The top portion of the right-hand (as shown in the drawing) pillar 22 mounts another check or stop ring 24*a* (FIG. 3) with spring 25*a* located between the ring and a bush 28 connected to the cross-arm 23. Above the bush 28 on the projecting end of the pillar 22 is arranged another spring 26*a* and the check or stop ring 27*a*.

The inside surface of the bush 28 is provided with a key groove with a key (not shown in the drawing) which prevents the bush 28 from being turned about the pillar 22. The pillar 22 is fitted with a corresponding key groove. Secured to the outside surface of the bush 28 is a bracket 29 with a stepped slot to receive a clamp 30 rigidly fixed on the cross-arm 23. To secure the clamp 30 in the slot of the bracket 29, a catch 31 is fastened to the bracket 29.

The catch 31 comprises a cylindrical casing 32, a core 33 and a spring 34 surrounding the core. The top (according to the drawing) end of the core 33 is introduced into an opening provided in the bracket 29 and a recess in the clamp 30 securing thereby the cross-arm 23.

Mounted at the center of the cross-arm 23 on shock absorbers 35 (FIG. 1) is the splitter 9 adapted to dissect the water column formed by the detonation. As to the shock absorber, use can be made of any known design which is suitable for such purpose.

According to another version of the present invention, the splitter 9 is a conical case 36 facing, with its apex, the vessel 1 and filled with a tough mass 37, such as, asphalt, to increase the mass of the splitter 9. The edge of the conical case 36 is bent downwards. The apex angle of the cone of the splitter 9 is chosen according to the mass of the water ejected during the explosion and the dimensions of the charge 7. In each specific case, the size of the apex angle is determined experimentally. The spacing between the splitter 9 and charge 7 is chosen according to the same variables. The location of the cross-arm 23 and splitter 9 on the pillars 22 is changed by shifting the check rings 24 and 27 and by the proper choice of the springs 25 and 26.

Figure 4:
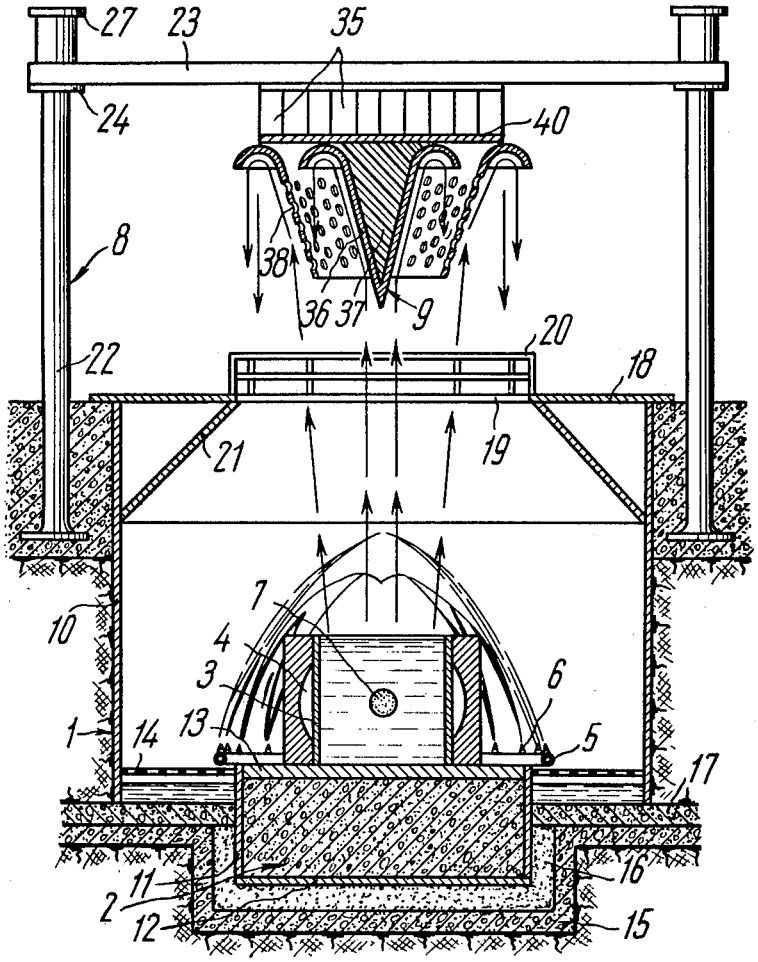
FIG. 4 is a longitudinal axial sectional view showing the layout of the plant for explosive forming with the splitter enclosed in a perforated case.

According to another version of the invention, the cone of the splitter 9 is additionally enclosed in a truncated conical perforated case 38 (FIG. 4) with downwardly bent edges. To provide for convenient erection, the smaller diameter of the case 38 is slightly in excess of the maximum diameter of the cone of the splitter 9.

The maximum diameter of the conical case 38 is selected according to the diameter of the top portion of the water column formed during the explosion, which in turn varies with the dimensions of the charge and the mass of the water being thrown out by the explosion.

Figure 5:
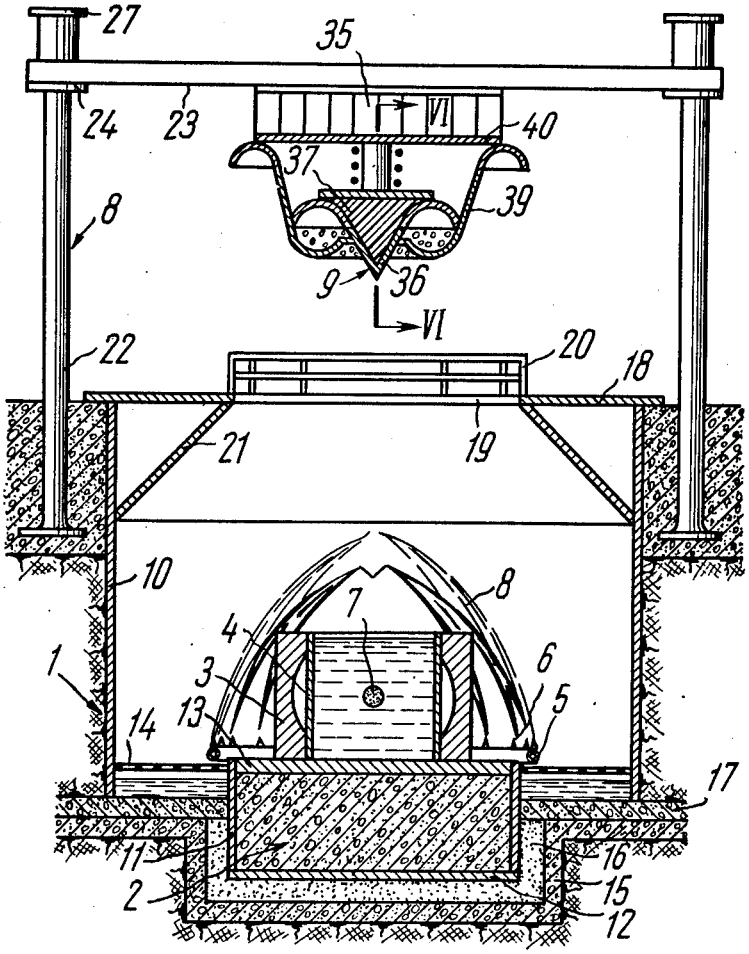
FIG. 5 is a longitudinal axial sectional view of the plant for explosive forming with the splitter mounted on a spring-biased rod.

A further embodiment of the splitter 9 resides in that the cone of the splitter 9 is additionally enclosed in a truncated conical case 39 (FIG. 5) bent outwardly along its large diameter and inwardly, into the cone formed by the case, along the small diameter. The bent edge of the conical case 39 is flanged downward along the large diameter and the portion of the case 39 bent inwardly is provided with perforations. In this case the volume contained within the conical case 39 is chosen so that it is approximately equal to that of the water ejected during the explosion.

In any of the above-described embodiments of the splitter 9, it is connected to the shock absorber 25 through a plate 40 to which are fastened both the cone of the splitter 9 and the case 38 or 39 in which it is enclosed.

Figure 6:
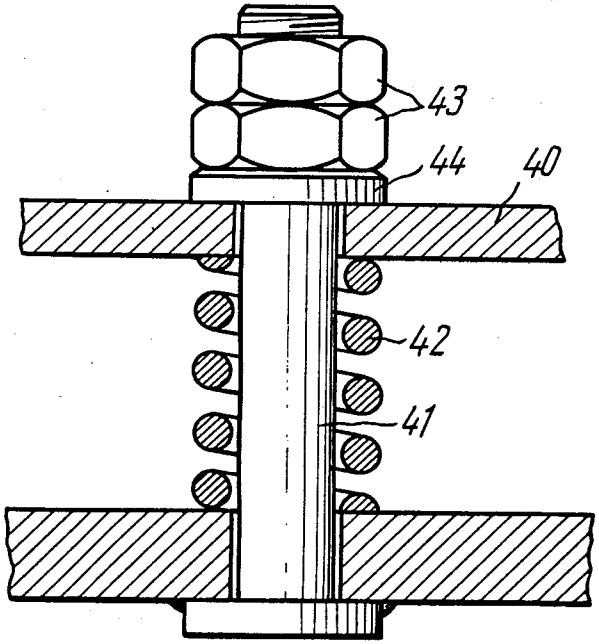
FIG. 6 is a view taken along the line VI-VI of FIG. 5 the view looking in the direction of the arrows and being on an enlarged scale.

In case the dimensions of the charge 7 approximate the maximum value for which the plant has been designed, it is expedient that the cone of the splitter 9 be mounted on a spring-biased rod 41, as shown in FIG. 6. The rod 41 is a metallic bar passing through an opening provided in the plate 40. The cone of the splitter 9 is secured to the bottom (according to the drawing) end of the rod 41. Intermediate the cone of the splitter 9 and the plate 40 is arranged a spring 42 which surrounds the rod 41. The rod 41 is made fast with respect to the plate 40 by nuts 43 and a washer 44.

The present plant for explosive forming operates in the following manner;

In the initial position, prior to operation, the cross-arm 23 with the splitter 9 is turned about the left-hand pillar 22 and displaced from the vessel 1. Near the vessel 1 on the erection ground, a die 3 with a blank 4 is mounted. The die 3 with the blank 4 is installed by a hoisting gear on the plate 13 of the anvil block 2 in the vessel 1. Next, the cross-arm 23 is turned about the left-hand pillar 22 to a position in which the splitter 9 is located above the opening 19 in the cover 18 of the vessel 1. When the cross-arm 23 is positioned above the vessel 1, the clamp 30 secured to the cross-arm 23 enters a slot in the bracket 29 fastened to the bush 28 which is arranged on the right-hand pillar 22. The clamp 30 is introduced into the slot until it strikes against the step provided therein. When the recess in the clamp 30 and the opening in the bracket 29 are in registry, the core 33 of the catch 31 mounted on the bracket 29 under the effect of a spring 34 will be introduced into the recess in the clamp 30 securing thereby the cross-arm 23. In this case, we have considered the operation of the plant when forming a component whose blank 4 has a closed outline (a shell). The space formed by the plate 13 of the anvil block 2 and the walls of the blank 4 is filled with a liquid medium, water in particular, which serves for transmitting the energy of detonation to the blank 4. An explosive charge 7 is placed into water poured into the space and secured to the die 3 with the aid of a special appliance. Both the dimensions and the outline of the charge 7 depend on the size, material and configuration of the component to be formed. Next, the header 5 is connected to the water pressure main, whereupon water is supplied through jets 6 thus forming a dome of sprayed water above the die 3 and blank 4 with the dome being intended to damp partially the shock wave and to protect the vessel 1 during the explosion of the charge 7. Thereafter, the charge 7 is exploded by a signal from a control panel. Immediately after the explosion, the header 5 is cut off from the water pressure main. The blank 4 is formed by the detonation energy and under the effect of water surrounding the charge 7, with the water acting as a punch. At the same time, the water contained above the charge 7 is ejected upwardly in the form of a column of sprayed liquid and detonation products.

The water column formed by the explosion is composed of three zones featuring different densities and speed of motion.

The first zone located in the top portion of the column consists of the particles of the liquid in the form of water sprays featuring a low density and moving with a supersonic speed.

In front of the dome composed of such dust-like sprays, a shock-wave is formed which rounds the dome as a solid body, forming a boundary between the air and water. The zone has a great kinetic energy but its operating time is small. The second zone, a cumulative gas-water stream, moves at a speed which is almost half as great as that of the first zone, with its density and operating time being far greater. The main fraction of the kinetic energy is concentrated in this zone. When the first zone of the water column reaches the flanged portion of the splitter 9 and is turned through 180°, it runs against the second zone on its way back. A counter-shock occurs with the ensuing spraying of water and damping of its energy. The pulverized dust-like liquid medium descends into the vessel 1 of the plant passing through the grating 14 under the vessel. The third zone is composed of the splashes of a uniform mass of water formed under the effect of elastic forces and waves reflected from the rigid surfaces of the die 3 and the component. In practice, the above zone does not reach the splitter 9.

The kinetic energy of the water column is taken up by the shock absorbers 35 of the splitter 9 which are compressed as a result and dissipate a fraction of the energy. Simultaneously, under the effect of the kinetic energy, the cross-arm 23 compresses the springs 26 which dissipate the larger portion of the energy taken up by the springs. On completion of the action of the water column, the cross-arm 23 returns by gravity and under the effect of the springs 26 to its initial position to rest on the springs 25 supported on the pillars 22 by the check rings 24. To remove the die 3 with the finished component from the vessel 1, the cross-arm 23 is set to its original position. To this end, the core 33 of the catch 31 is lowered manually thus compressing the spring 34. As a result, the core 33 is withdrawn from the recess in the clamp 30 connected to the cross-arm 23. As soon as the cross-arm 23 is released, it is turned manually or by an electric hoist about the left-hand pillar 22.

Next, the die 3 with the finished component is removed from the vessel 1 via a hoisting gear. As for the hoisting gear, use may be made of e.g., a bridge crane servicing several plants.

The die 3 with the finished component is placed on the erection ground to be stripped.

Depending upon the dimensions and outline of the charge 7, the mass of water and configuration of the component required, the splitters of different construction are utilized.

In case a flat charge 7 is used and, hence, the water column set up by the explosion has a comparatively large cross-sectional area at its base, use is made of a splitter 9 enclosed in a conical perforated case 38. On this occasion, the central portion of the water column flowing off from the edges of the flanged section of the conical case 36 of the splitter 9 strikes against the inside surface of the perforated case 38, passes through its openings and creates a counterpressure in a peripheral portion of the water column relieving thereby partially the shock absorber 35.

Figure 7:
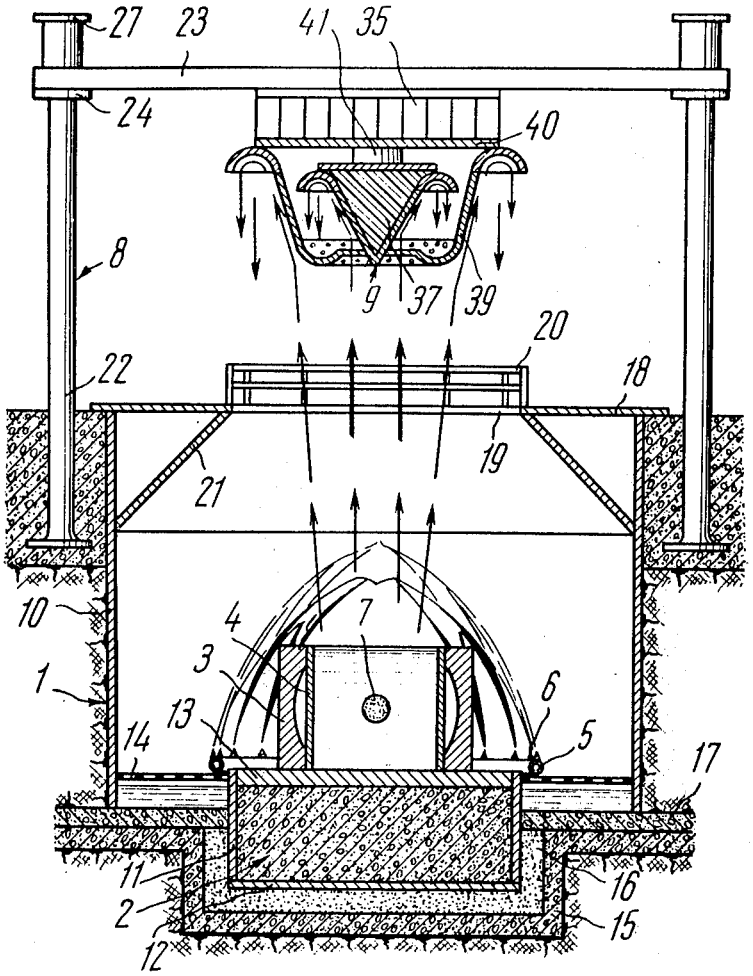
FIG. 7 is a view the same as in FIG. 5 at the moment of detonation.

If the dimensions of the charge 7 approximate the value for which the plant has been designed, the water column thrown out by the explosion being rather small, use is made of a splitter 9 enclosed in a conical case flanged at both bases. If such is the case, it is most expedient that the splitter 9 be mounted on a spring-biased rod 41, as shown in FIG. 7.

Upon running against the surface of the splitter 9, the central portion of the water column given off a fraction of the kinetic energy, with the splitter 9 being thereby shifted upwards compressing the spring 42 and opening fully the passage into the space formed by the conical case 38. The water flowing off from the flanged portion of the conical case 36 is directed onto the part of the conical case 39 bent inwardly, passes through its openings and upon encountering the ascending masses of the sprayed water absorbs a fraction of their energy, relieving thereby the shock absorber 35. The peripheral part of the water column flows around the case 39 from the outside passing downward into the vessel 1 from the edge of the top bead.

Where the blank 4 is a flat sheet secured in a horizontal position to the die 3, the water and charge 7 are placed into a so-called single-application vessel (not shown in the drawing) to be installed on the sheet.

When large-size dies 3 are use, both the erection of the blank 4 thereon and the removal of the finished component are performed directly within the vessel 1.

Since the pillars mounting the splitter are installed separately from and independently of the vessel 1, the vessel 1 is not subjected to the force of the explosion with the advantages resulting therefrom.

The invention is not to be confined to any strict conformity to the showings in the drawings but changes or modifications may be made therein so long as such changes or modifications mark no material departure from the spirit and scope of the appended claims.

What we claim is:

1. A plant for explosive-forming articles of different size comprising a vessel; a die having means mounting a blank secured thereto, said die being located in said vessel; means for accommodating a liquid medium in said vessel; the liquid medium contained in said means being arranged to transmit the energy of detonation to said blank; an explosive charge placed into the liquid medium enclosed in said means; an exposed support separate from and independent of said vessel, located near said vessel but not conncted thereto; a splitter for disecting a liquid medium column formed by said exposed support separate from and independent of said vessel located near said vessel; a splitter for disecting a liquid medium column formed by an explosion, said splitter being fixedly mounted and exposed above said vessel on said support; and a shock absorber arranged intermediate said support and splitter and means adapted to connect the support and shock absorber.

2. A plant for explosive-forming articles of different size comprising a vessel; a die having means mounting a blank secured to, said die being located in said vessel; means for accommodating a liquid medium in said vessel; the liquid medium contained in said means being arranged to transmit the energy of detonation to said blank; an explosive charge in the liquid medium enclosed in said means; a support separate from and independent of said vessel located near said vessel; a splitter for disecting a liquid medium column formed by an explosion, said splitter being fixedly-mounted above said vessel on said support; and a shock absorber arranged intermediate said support and splitter and means adapted to connect the support and shock absorber, the support being defined by at least two pillars on which is arranged a spring-biased cross-arm carrying the splitter and mounted so as to be rotatable about one of the pillars in the course of erection of the die with the blank and their removal from the vessel.

3. A plant for explosive-forming articles of different size comprising a vessel; a die having means mounting a blank secured to, said die being located in said vessel; means for accommodating a liquid medium in said vessel; the liquid medium contained in said means being arranged to transmit the energy of detonation to said blank; an explosive charge in the liquid medium enclosed in said means; a support separate from and independent of said vessel located near said vessel; a splitter for disecting a liquid medium column formed by an explosion, said splitter being fixedly-mounted above said vessel on said support; and a shock absorber arranged intermediate said support and splitter and means adapted to connect the support and shock absorber, the splitter is defined by a conical case filled with a tough mass and facing with its apex the vessel, said case having edges flanged and bent downward and with the apex angle being chosen according to the dimensions of the charge and the volume of liquid medium transmitting the energy of detonation to the blank.

4. The plant as claimed in claim 3, in which the splitter is enclosed in a truncated conical case, said case having edges bent downward, and whose smaller diameter is slightly in excess of the maximum diameter of the splitter.

5. The plant as claimed in claim 3, in which the splitter is enclosed in a truncated conical case, bent inwardly part of the case being provided with perforations.

6. The plant as claimed in claim 3, including a plate to which the splitter is connected to the shock absorber in which the splitter is provided with a rod adjoining the base of the cone and passing through an opening in the plate in order to move vertically relative to the plate at the moment of explosion of the charge.

* * * * *